United States Patent [19]

Rothrock

[11] 3,939,791

[45] Feb. 24, 1976

[54] LATERAL SUPPORT OF AN LNG SHIP TANK USING FLEXIBLE BRACING

[75] Inventor: Elmer Weyman Rothrock, Hinsdale, Ill.

[73] Assignee: Chicago Bridge & Iron Company, Oak Brook, Ill.

[22] Filed: Sept. 23, 1974

[21] Appl. No.: 508,280

[52] U.S. Cl. ..... 114/74 A
[51] Int. Cl.[2] ..... B63B 25/16
[58] Field of Search ..... 114/74 R, 74 A, 74 T; 220/9 LG, 15, 12

[56] References Cited

UNITED STATES PATENTS

| | | | |
|---|---|---|---|
| 3,076,423 | 2/1963 | Leathard | 220/15 |
| 3,273,740 | 9/1966 | Herrenschmidt | 220/9 LG |
| 3,712,257 | 1/1973 | Alleaume | 114/74 A |

*Primary Examiner*—Trygve M. Blix
*Assistant Examiner*—Stuart M. Goldstein
*Attorney, Agent, or Firm*—Merriam, Marshall, Shapiro & Klose

[57] ABSTRACT

A ship having a hold with a bottom, and a vertically positioned tank with a top and bottom standing in gravity support on the hold bottom, said tank having a portion circular in horizontal section between the tank top and tank bottom, a circular restraining wall horizontally positioned around the tank, and equally spaced from, the circular portion of the tank, and a plurality of pairs of cross-braces joined to the cylindrical portion of the tank and extending therefrom and joined to the circular restraining wall, said cross-braces accommodating expansion and contraction of the tank with temperature change while providing support against lateral movement of the tank during pitching and rolling of the ship.

7 Claims, 7 Drawing Figures

LATERAL SUPPORT OF AN LNG SHIP TANK USING FLEXIBLE BRACING

This invention relates to ships used for transporting cryogenic liquefied gases. More particularly, this invention is concerned with improvements in transporting cryogenic liquefied gases in ship tanks which are free-standing and are supported by the ship hold bottom.

Many useful gases are available or are produced at geographical locations far removed from the locations where they are used or needed. Although some such gases can be economically transported under pressure in the form of a gas, it is generally more desirable to liquefy the gas and transport it in that state because of the increased volume of gas which can be transported in liquid state compared to the gaseous state.

Some gases can be liquefied at moderate pressures and shipped in tanks capable of maintaining the gas under such pressure to keep it in the liquefied state. Propane and butane are representative of such gases. Because the pressure needed to liquefy such gases at atmospheric temperature is not unduly great, a pressure vessel required for storage of the so-liquefied gas can be built economically and of a relatively large size. Other gases, however, cannot be readily liquefied even at fairly high pressures unless the temperature of the gas is also reduced substantially below atmospheric temperature. Because it is difficult and expensive to construct a pressure vessel capable of storing a cryogenic liquefied gas at high pressure in large volume, it has been found more practical and less expensive to cool the liquefied gas to a temperature at which it can be stored in a tank designed to withstand a minimum internal pressure plus dynamic loads due to ship motions. For example, it has been found convenient to store liquefied natural gas, which is essentially methane, at about −260°F. and at about 15 psia or just slightly above atmospheric pressure. Other cryogenic liquefied gases such as hydrogen, helium and ethylene can be similarly stored at about atmospheric pressure following their refrigeration to a temperature below the boiling point of the gas at such pressure.

Tanks for transporting cryogenic liquefied gases at about atmospheric pressure in a ship are of two main types. The first type of tank is one in which the tank walls and bottom are substantially continuously supported by the ship hold bottom and walls. Such a tank relies upon the structure of the ship for the strength and support needed to contain the liquid being stored. The second type of tank is a structurally self-supporting or free-standing tank which is spaced or separated from the ship hold wall. Such a tank does not rely on the strength of the hold walls for necessary reinforcement because it is structurally independent of the ship walls insofar as its ability to effectively contain a stored liquid is concerned.

One of the structurally independent type of tanks is cylindrical with a hemispherical bottom and top. Such a tank can be mounted in the ship hold on a metal cylindrical vertical skirt or on a plurality of columns.

Another type of free-standing tank has a structurally self-supporting or shape retaining vertical cylindrical wall and roof which is spaced or separated from the ship hold walls and which has a bottom structure which spreads the weight of the tank and any load therein over a substantial area of the ship hold bottom. The bottom is either flat over its entire area extending to the tank wall or it is flat over most of the area with a toroidal knuckle or conical section, or combination of such elements, joining it to the tank wall. Load bearing insulation between the hold bottom and the tank bottom prevents the tank contents from cooling the hold bottom to a low temperature which could affect its strength.

Although free-standing tanks can be readily placed on a ship hold bottom to bear static gravity loads, ancillary supporting means should be provided to prevent lateral movement of the tank in the hold. The supporting means needed for that purpose must provide the desired support during all vertical and horizontal dimensional expansions and contractions induced in the tank with temperature changes.

According to the present invention, there is provided, in combination, a ship having a hold with a bottom, a vertically positioned tank with a top and bottom standing in gravity support on the hold bottom, said tank having a vertical portion circular in horizontal section between the tank top and tank bottom, a circular restraining wall horizontally positioned around the tank, and equally spaced from, the circular portion of the tank, and a plurality of pairs of tank supporting cross-braces joined to the circular portion of the tank and extending therefrom and joined to the circular restraining wall, said cross-braces accommodating expansion and contraction of the tank with temperature change while providing support against lateral movement of the tank during pitching and rolling of the ship. The circular restraining wall, to which the cross-braces are joined, can be a separate girder in a ship hold of square or rectangular shape, or it can constitute the wall of a circular cylindrical vertical ship hold wall.

The bracing system of the invention can be used with vertical cylindrical tanks, spherical tanks, conical tanks and tanks which are combinations of such shapes or similar shapes. An important feature, regardless of the particular overall shape of the tank, is that the cross-braces be joined to a circular part of the tank taken along a horizontal line so that forces due to radial and vertical expansion and contraction of the tank are applied equally to all of the braces. The connection of the braces substantially tangentially to the tank further aids in achieving this goal.

To achieve equal distribution of forces in the bracing system, induced by temperature change in the tank, it is advisable for each pair of cross-braces to be identical and uniformly spaced around the tank. Equal distribution of such forces is further effected by having the circular restraining wall equally positioned about the adjacent periphery of the tank so that the cross-braces can be made of essentially the same length. In addition, joining the cross-braces to a restraining wall at a height lower than the height at which they are joined to a tank permits the cross-braces to more readily accommodate the temperature induced dimensional changes in the tank. This is because as the tank height is decreased with decrease in temperature, so will the braces decrease in length since they are also cooled at the ends joined to the tank.

Each pair of cross-braces can comprise two elongated members arranged and positioned so that when one member is in tension the other member can be in compression. In addition, each of the two elongated members is advisably positioned to function as a load bearing element independent of the other.

The cross-braces can be installed in a predetermined pre-stressed condition at ambient atmospheric temperature so that when the tank is cooled, as when a liquefied gas is stored in the tank, the positional change and displacement of the tank relative to the braces will result in internal stress-free braces.

Either the tank exterior or the ship hold wall interior surface is insulated to keep the ship from becoming cold and thereby reducing its strength. Furthermore, the cross-braces should be insulated at least along that part of their end which is subjected to the extremes of hot and cold to facilitate development of an internal temperature gradient in the braces.

The invention will be described further in conjunction with the attached drawings in which.

So far as is practical, the same elements or parts which appear in the different views of the drawings will be identified by the same numbers.

Figure 1:
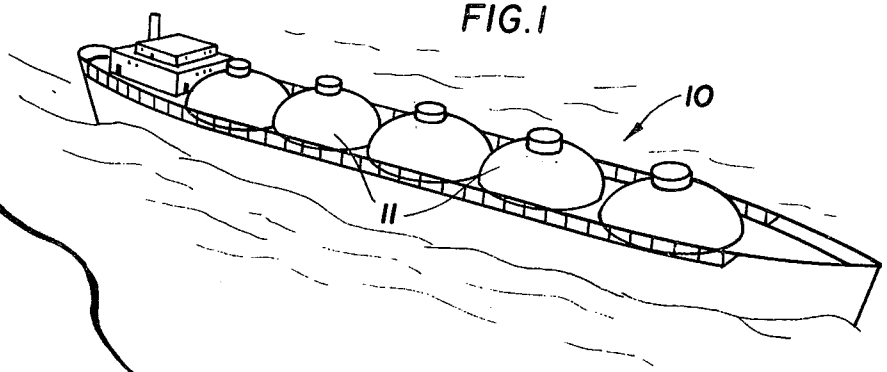
FIG. 1 is an isometric view of a liquefied gas transporting ship containing tanks supported by the bracing system of this invention.
Figure 2:
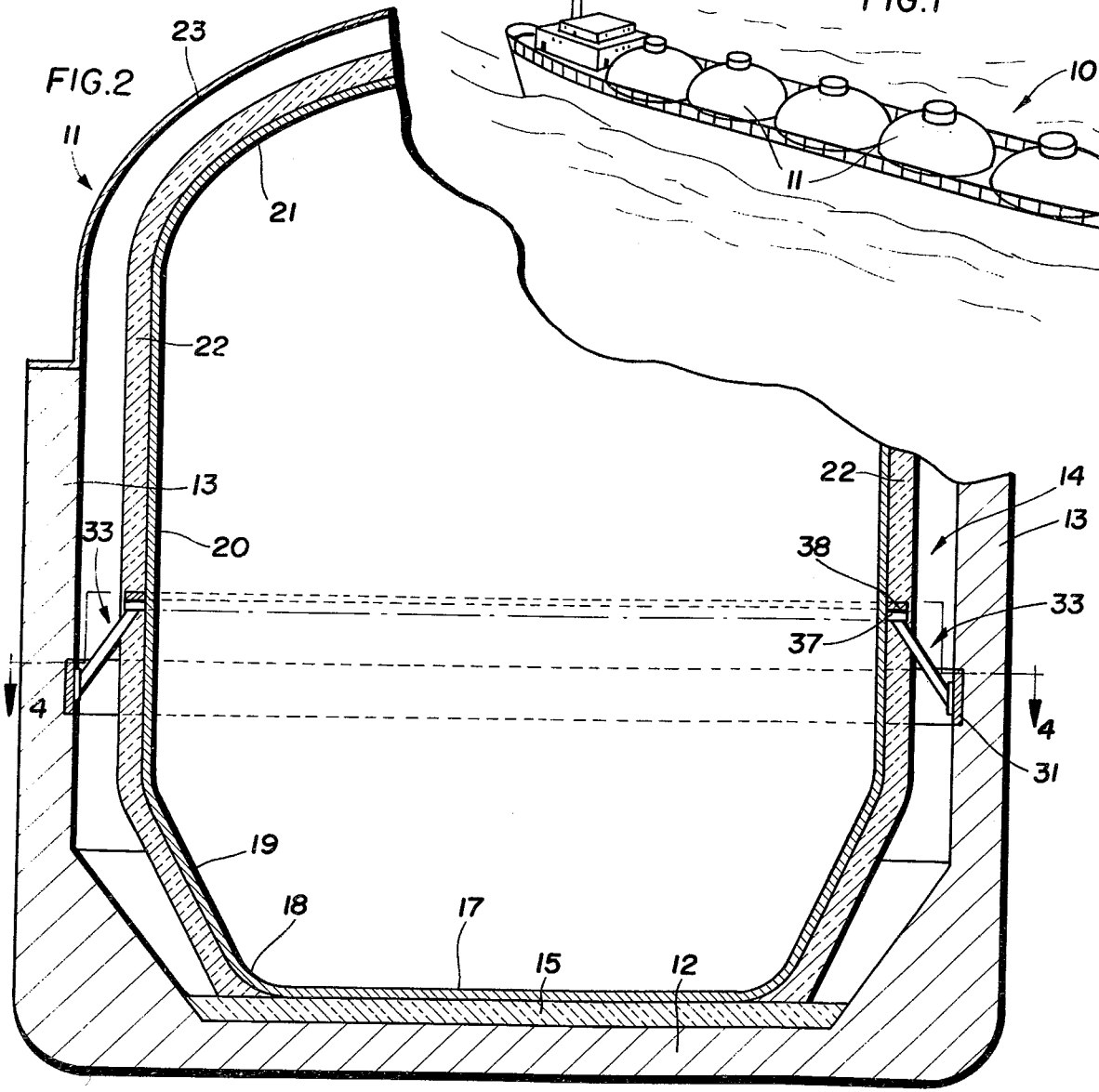
FIG. 2 is a vertical lateral sectional view taken through the ship, and one of the tanks, shown in FIG. 1.

With reference to FIG. 1, the ship 10 has five tanks 11 for storing and transporting a liquefied gas, such as liquefied natural gas at about −260°F. and 15 psia. As shown in FIG. 2, each ship tank 11 is in a hold which has a bottom 12 and sides 13 which define the hold 14. Load bearing insulation 15 is on the bottom of the ship hold 14. The tank 11 has a flat metal bottom 17 which is joined to a toroidal metal shell knuckle 18 which extends to a conical metal shell section 19. The conical shell section 19 joins the vertical cylindrical circular central shell portion 20 of the tank. The lower edge of the semi-elipsoidal metal top 21 is joined to cylindrical shell portion 20 to thereby form a completely enclosed tank. Insulation 22 is positioned on the entire exterior side and top surfaces of the tank. Exterior metal cover 23 over the tank is joined at its lower peripheral edge to the ship deck to complete enclosure of the tank and the ship hold to thereby protect the entire hold interior from the environment.

Figure 3:
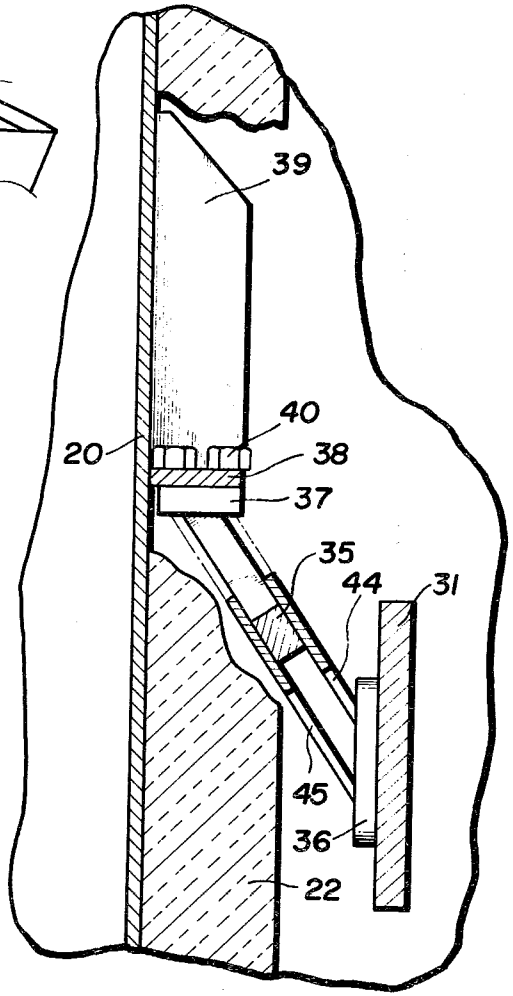
FIG. 3 is an enlarged sectional view of the bracing structure on one side of the tank shown in FIG. 2.
Figure 4:
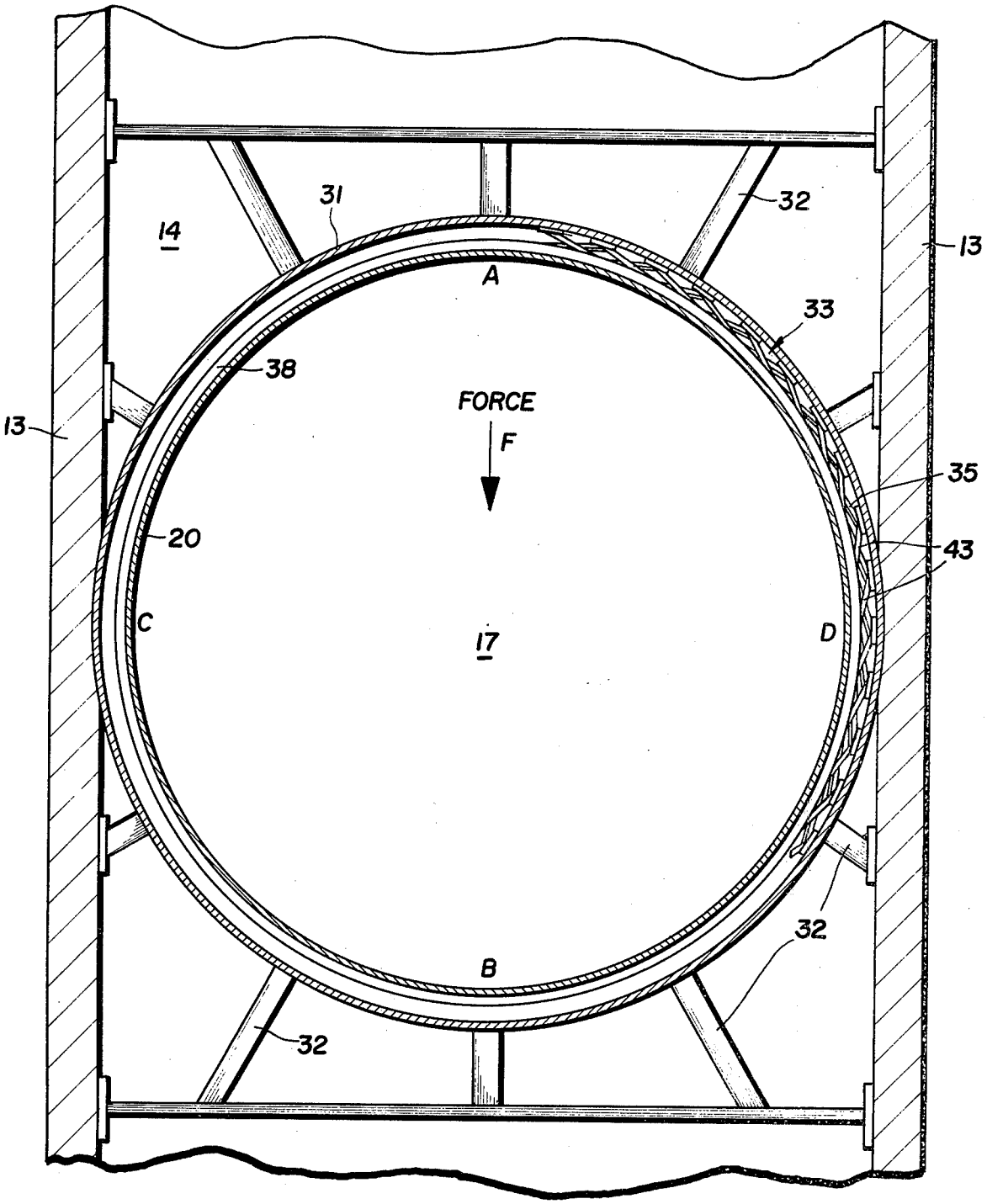
FIG. 4 is a horizontal sectional view taken along the line 4—4 of FIG. 2.
Figure 5:
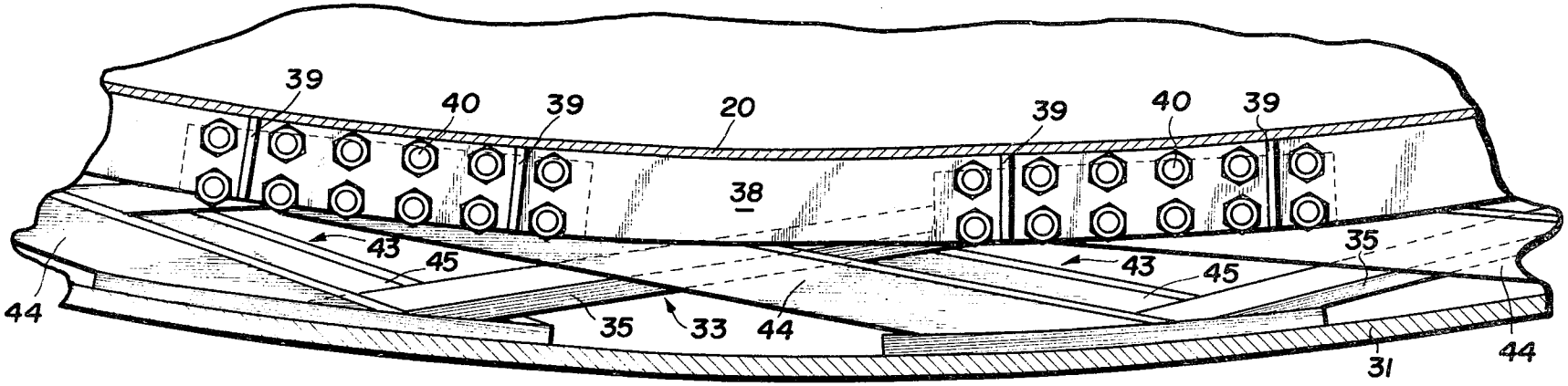
FIG. 5 is an enlarged plan view of the cross-braces shown in FIG. 4.

Positioned inside of the ship hold 14 is a circular restraining wall in the form of a girder 31 as shown in FIGS. 2 to 4. The girder 31 is equally spaced from the adjoining tank surface. A plurality of beams 32 (FIG. 4) hold the circular girder 31 in fixed position in the ship hold.

Positioned between the girder 31 and the tank wall 20 is a plurality of pairs of cross-braces 33. Each pair of cross-braces 33 is joined at its outer end to the girder 31 and at its inner end to the tank.

Each pair of cross-braces 33 is composed of two elongated members. One of these elongated members 35 is joined at its outer end to a plate 36 which is joined to the inner vertical surface of girder 31. The inner end of elongated member 35 is welded to a plate 37 which is positioned horizontally. The plate 37 is joined by bolts 40 to a horizontally positioned flange 38 which is welded to the outer periphery of the tank shell portion 20. The flange 38 extends completely around the tank. A pair of vertical plates 39 reinforce plate 38 in the location where each plate 37 is bolted to it.

Figure 6:
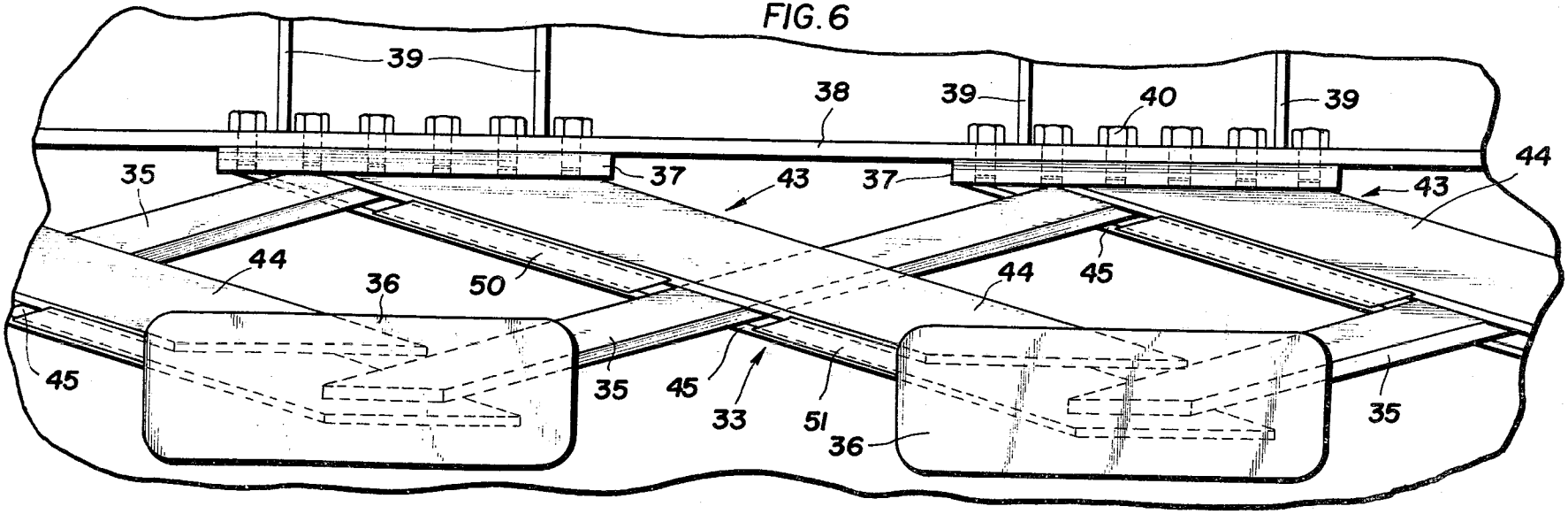
FIG. 6 is an elevational view of the cross-braces of FIG. 5 but with the restraining wall, to which the braces are joined, removed for clarity.

Each pair of cross-braces 33 has a second elongated member 43 placed so as to cross the elongated member 35. Elongated member 43 consists of two metal bars 44 and 45. Elongated member 35 is positioned between the bars 44 and 45 comprising elongated member 43. Each of the said elongated members 35 and 43 is free to move with respect to the other. The inner ends of bars 44 and 45 are welded to metal plate 37 and the outer ends of the bars are welded to plate 36. To keep the two bars 44 and 45 equally spaced apart when under load, shear plates 50 and 51 (FIG. 6) can be welded to the sides of the two bars.

The described cross-bracing system secures the tank 11 against lateral movement in the ship hold. In addition, the cross-braces secure the tank against vertical movement produced by over-turning forces or an uplift force on the tank shell such as can result from internal pressure or product load. The elongated cross-braces 35 and 43 are arranged in X bracing arrangement with the ends joined to the tank approximately tangentially. Tangential positioning of the braces provides the necessary flexibility for accommodating the dimensional changes which result from expansion and contraction of the tank as a result of temperature changes.

As shown in FIG. 4, when a horizontal force is applied along the line F as shown in the drawing, the elongated members 43 in the areas C and D of the cross-braces are placed in tension, while the elongated members 35 in those areas are placed in compression. Each pair of cross-braces progressively located away from the areas C and D towards the area B of the tank has the tensile load in members 43, and the compression load in members 35, reduced. The cross-braces in the area B are both in compression. Similarly, in the area A of the tank, the cross-braces of each pair are in tension, although they do not bear a tensile load anywhere near as high as that in members 43 in the areas C and D when the force F is applied. Of course, when the lateral force is applied in a different direction than the force F the cross-braces will respond in a similar manner. It should be understood that, regardless of the lateral force which is applied to the tank, those braces which are more or less parallel to the line of force are subjected to the greatest compressive and tensile loads.

The size of the cross-braces and the dimensions of each of the elongated members 35 and 43 must be precalculated to accommodate the dimensional change of the tank shell with changes in temperature. The cross-braces obviously must be of adequate strength to withstand the loads to which they are subjected. The anticipated temperature contractions of the bracing and the tank shell and the stress growth of the tank shell are first computed. The geometry of the pairs of cross-braces is then determined so that the calculated movements can occur without producing loads in the cross-braces. The cross-braces are then installed at ambient atmospheric temperature with an initial flexure equal to the resultant of the radial and vertical tank shell calculated movements. The tank shell movements will occur as the tank is cooled and filled with a liquefied gas product, such as liquefied natural gas at about −260°F. and 15 psia. After the movements take place upon cooling of the tank, the cross-braces will be essentially stress free and in position to assume the loads which are imposed on them. The cross-braces accordingly must be designed so that they are sufficiently flexible for the ambient temperature springing and yet have sufficient stiffness to act as compression members when lateral loads are applied to the tank.

Figure 7:
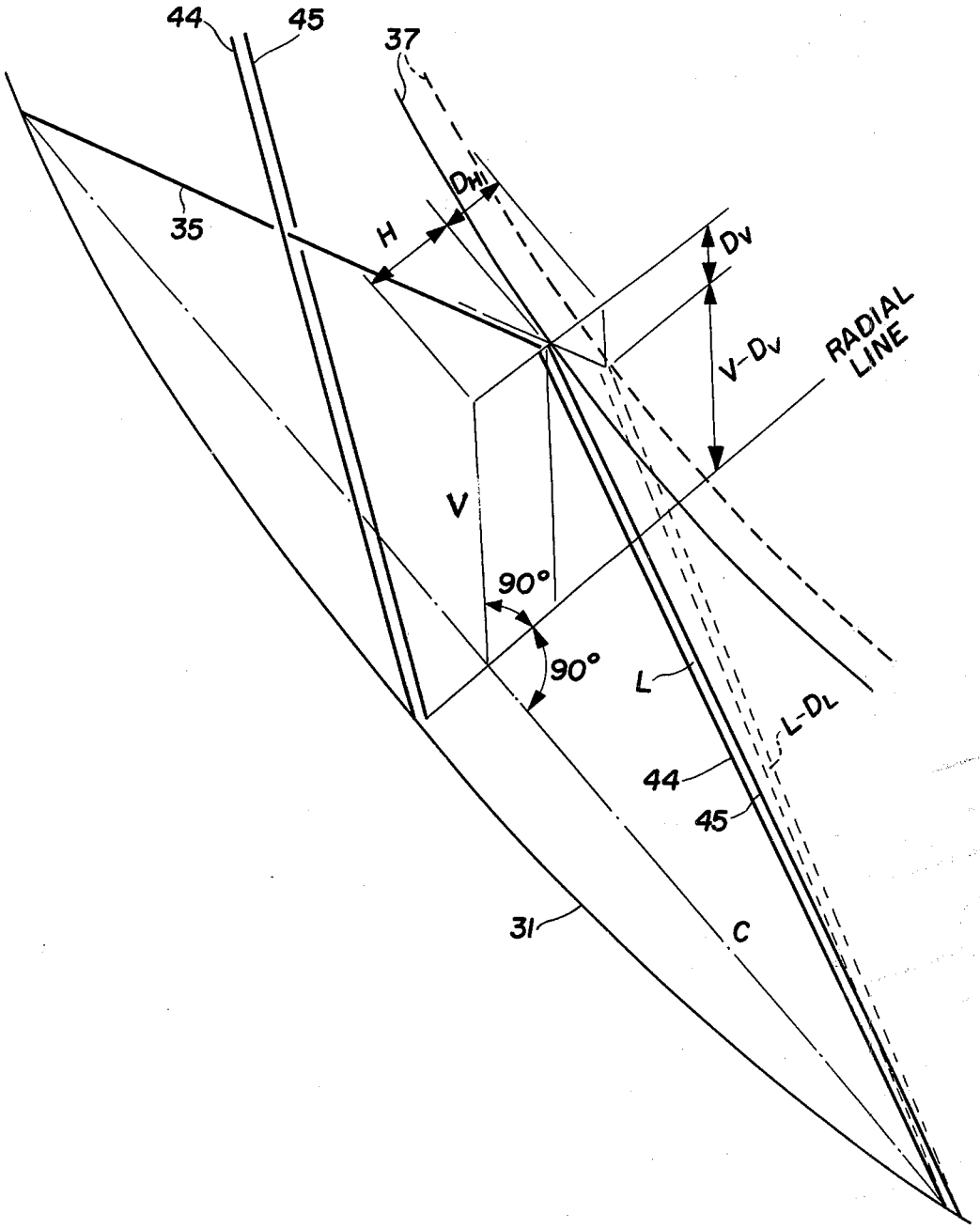
FIG. 7 is a perspective view showing dimensional changes in a tank and cross-braces with temperature changes.

FIG. 7 illustrates in a schematic perspective view the mathematical measurements to be taken into account in determining the length of the cross-braces and their positioning on the tank and the ship hold girder. In FIG. 7:

$C$ = one-half of the chord distance between adjacent points of attachment of the cross-braces to the ship hold girder $H$ = the radial horizontal distance from the chord to the attachment of the braces to the tank girder $D_H$ = computed radial temperature contraction of the tank girder $D_V$ = computed vertical movement of the tank girder due to the temperature contraction of the tank shell $L$ = cross-brace length $D_L$ = contraction in length of the cross-brace due to temperature $L = \sqrt{C^2 + H^2 + V^2}$ $V = 1/2\ D_V\ [2H(D_H) + 2L(D_L) + D_V^2 + D_H^2 - D_L^2]$ exact expression for V $V = L(D_L) + H(D_H)/D_V$ approximate expression for V The following procedure can be followed for determining V.

1. Assume a length for V
2. Compute L from $L = \sqrt{L^2 + H^2 + C^2}$
3. Compute temperature contraction $D_L$
4. Compute V using the approximate expression $V = L(D_L) + H(D_H)/D_V$
5. Compare computed length of V with the assumed length. Repeat the procedure with a new length for V until the computed length and assumed length agree.
6. Make a final check of the assumed length by comparing with the computed length obtained from the exact expression.

$$V = 1/2\ D_V\ [2H(D_H) + 2L(D_L) + D_V^2 + D_H^2 - D_L^2]$$

It is thus seen that the positioning and length of the cross-braces required in the invention can be determined mathematically by a structural engineer.

EXAMPLE

A 57 foot radius tank of 9% nickel alloy steel is supported by 48 pair of cross-braces. Each pair of cross-braces comprises a steel bar 5 × 3.5 inches by an average length of 8 feet 2⅜ inches long, and a pair of plates 11.5 × 0.75 inches by an average length of 8 feet 2⅜ inches long.

The space between the tank wall and the ship hold is 2 feet 0.5 inch and the horizontal distance from the center of attachment of the cross-braces to the tank girder to the center of attachment of the cross-braces to the hold girder is 1 foot 5 inches. The vertical distance from the same points of attachment is 2 feet 3 inches.

The foregoing detailed description has been given for clearness of understanding only, and no unnecessary limitations should be understood therefrom as modifications will be obvious to those skilled in the art.

I claim:

1. In combination:
   - a ship having a hold with a bottom,
   - a vertically positioned tank with a top and bottom standing in gravity support on the hold bottom, said tank having a portion circular in horizontal section between the tank top and tank bottom,
   - a circular restraining wall horizontally positioned around the tank, and equally spaced from, the circular portion of the tank, and
   - a plurality of pairs of flexible cross-braces fixedly joined substantially tangentially to the circular portion of the tank and extending therefrom and fixedly joined to the circular restraining wall, said cross-braces accommodating expansion and contraction of the tank with temperature change while providing support against lateral movement of the tank during pitching and rolling of the ship.
2. A combination according to claim 1 in which the tank is insulated.
3. A combination according to claim 1 in which the pairs of cross-braces are essentially identical and uniformly spaced around the tank.
4. A combination according to claim 1 in which the cross-braces are joined to the restraining wall at a height lower than the height at which they are joined to the tank.
5. A combination according to claim 1 in which each pair of cross-braces has two elongated members, and when one member is in tension the other member of the pair can be in compression.
6. A combination according to claim 1 in which each of the two elongated members functions as a load bearing element independent of the other.
7. A combination according to claim 1 in which the cross-braces are in prestressed condition at ambient atmospheric temperatures and are free of internal stresses at sub-atmospheric temperatures at which a liquefied gas is stored in the tank.

* * * * *

UNITED STATES PATENT AND TRADEMARK OFFICE

CERTIFICATE OF CORRECTION

PATENT NO. : 3,939,791

DATED : February 24, 1976

INVENTOR(S) : Elmer Weyman Rothrock

It is certified that error appears in the above-identified patent and that said Letters Patent are hereby corrected as shown below:

Column 5, lines 29 and 45, change "1/2 $D_V$" to -- $\frac{1}{2D_V}$ --; lines 30 and 38, change "$L(D_L) + H(D_H)/D_V$" to -- $\frac{L(D_L) + H(D_H)}{D_V}$ --.

Signed and Sealed this

*eleventh* Day of *May 1976*

[SEAL]

*Attest:*

RUTH C. MASON
*Attesting Officer*

C. MARSHALL DANN
*Commissioner of Patents and Trademarks*